United States Patent [19]

Kozima et al.

[11] 4,168,241

[45] Sep. 18, 1979

[54] LUBRICANT AND METHOD FOR NON-CHIP METAL FORMING

[75] Inventors: Takashi Kozima, Nagoya; Shigehiro Ogisu, Tokai, both of Japan

[73] Assignee: Aichi Steel Works, Limited, Tokai, Japan

[21] Appl. No.: 886,499

[22] Filed: Mar. 14, 1978

[51] Int. Cl.[2] ..... C10M 3/18; C10M 5/14; C10M 7/20; B21B 45/02

[52] U.S. Cl. ..... 252/18; 72/42; 252/25; 252/30

[58] Field of Search ..... 252/30, 25, 18; 72/42

[56] References Cited

U.S. PATENT DOCUMENTS

| | | | |
|---|---|---|---|
| 2,335,933 | 12/1943 | Goheen et al. | 252/30 |
| 3,066,098 | 11/1962 | Nichols | 252/25 |
| 3,111,381 | 11/1963 | Panzer et al. | 252/25 |
| 3,259,573 | 7/1966 | Odell | 252/25 |
| 3,377,279 | 4/1968 | Sibert | 252/30 |
| 3,826,744 | 7/1974 | Hollnski et al. | 252/25 |
| 4,003,839 | 1/1977 | Van Hesden | 252/25 |

*Primary Examiner*—Delbert E. Gantz
*Assistant Examiner*—Irving Vaughn
*Attorney, Agent, or Firm*—Karl W. Flocks

[57] ABSTRACT

A lubricant for non-chip metal forming comprising (1) 5% by weight or more of at least one powdered sulfate selected from the group consisting of calcium sulfate and barium sulfate having a mean particle size of 100 $\mu$ or less and (2) at least one conventional lubricant selected from the group consisting of inorganic solid lubricants, organic solid lubricants and organic liquid lubricants. This lubricant is excellent in galling resistance (anti-weld property) as well as in other properties required for a lubricant for non-chip metal forming. In the non-chip metal forming using this lubricant, it is sufficient to subject the raw material to a simple pretreatment such as pickling or shot blasting to accomplish the desired non-chip metal forming.

43 Claims, 6 Drawing Figures

LUBRICANT AND METHOD FOR NON-CHIP METAL FORMING

Figure 1:
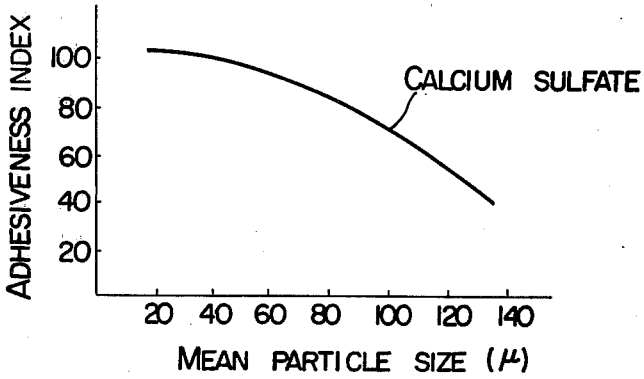

This invention relates to a lubricant for the non-chip metal forming of a metal such as steel, aluminum, copper or the like, having an excellent galling resistance, low friction coefficient and good adherence, and also to a method for non-chip metal forming such as forging, rolling, drawing or straightening by using said lubricant.

In conventional non-chip metal forming, it has been necessary for the slug to undergo a complicated pretreatment in order to prevent galling. For instance, in the cold forging of steel, Bonderite-Bonderlube treatment was applied as lubricating treatment. Although the Bonterite-Bonderlube lubrication results in good performance, such a treatment is complicated to carry out and, in addition, presents water pollution being due to heavy metal ions, so that an alternative process which is simpler and free from water pollution has recently been desired. The oxalate treatment, which has been practiced as lubrication in the cold forming of stainless steel, exhibits a desirable lubricity but the operational procedure is complicated. In the warm forging, since an oxide film is difficult to form and the lubrication conditions are severe, it has been customary to coat the slug with a lubricant and, at the same time, to spray a lubricant onto the die. Such a dual lubrication is undesirable for the working environment because of splashing of a lubricant such as, for example, aqueous colloidal graphite solution.

The performance of a lubricant for non-chip metal forming is governed by the working temperature of the forming process, surface pressure, etc. Properties generally required for a lubricant for warm and hot non-chip metal forming include a high temperature stability, being not susceptible to oxidation loss nor to decomposition, a low friction coefficient, a sufficient adherence to both die and slug, a good galling resistance and an economical advantage.

There have heretofore been employed as lubricant for non-chip metal forming solid lubricants having a lameller crystal structure, such as graphite, graphite fluoride, molybdenum disulfide and tungsten disulfide. These solid lubricants, however, are unsatisfactory in galling resistance and in lubricating performance at a high temperature of 300° to 500° C. or higher because of causing oxidation which results in an increase in friction coefficient leading to unsatisfactory lubricating performance.

There have also been known organic lubricants in the powder, solid, grease or liquid form or compound lubricants comprising said organic lubricants and the afore-noted solid lubricants for non-chip metal forming. These lubricants have also a reducing effect on friction coefficient but have a defective galling resistance similarly to the afore-noted solid lubricants.

Further, alkali metal sulfates have been known as lubricants (cf., for example, U.S. Pat. Nos. 3,066,098 and 3,826,744), and alkali earth metal sulfates have been also known as agents for improving the adherence of solid lubricants having a layer lattice structure (U.S. Pat. No. 3,377,279). However, nothing is known with respect to the galling resistance of such sulfates.

It has long been known that because of difficulty in formation of an oxide film and a low thermal conductivity, stainless steel, in particular, is readily picked up in non-chip metal forming such as forging, rolling or drawing. Since the galling results in deterioration of surface evenness of the workpiece and in reduction of the life of tools such as rolls and dies, which presented a serious problem. Since the aforementioned lubricants cannot prevent the galling or picking up, development of a lubricant having an excellent galling resistance has been desired.

The term "galling" or "picking up" used herein means such a phenomenon that when two metals contact directly with each other and one of the metals moves relatively to the other, the temperature of the points of contact increases locally owing to the accumulated frictional heat until fusion and subsequent welding of the metals take place and thereafter one of the metals adheres to the other and chips off owing to the shearing stress generated by the relative moving of one metal to the other. When the two metals in question are a combination of a tool having a higher shearing strength and a slug having a lower shearing strength, as in the case of forging, rolling or drawing, the metal of lower shearing strength adheres to the metal of higher shearing strength. The adhered part of the metal becomes protruded, resulting in increased points of contact between two metals, thus causing, in turn, increased protrusion. On the surface of the other metal, there appear streaks which subsequently grow into grooves. Thus, occurrence of the galling in forging, rolling or drawing results in deterioration of the surface quality of the final product. Further, when galling occurs on the surface of a tool such as a die and a roll, microscopic cracks appear in the vicinity of the adhered metal owing to repeated shearing action caused by the relative movement of the metals. Such micro-cracks may cause chipping of the tool surface. In this manner, the galling causes wear of the tool and, hence, the life of the tool is shortened. Such a tendency is more pronounced particularly in the case of a metal such as stainless steel having a low thermal conductivity and a low susceptibility to oxide film formation. According to the experience of the present inventors, in non-chip metal forming, for example, in hot rolling of a stainless steel round bar (type AISI 430), the product obtained was so poor in surface quality that peeling was needed after rolling. In another example of warm forging of a metal (AISI 304), the forging was impossible because when forming under severe conditions, such as backward extrusion, was done with a conventional colloidal graphite as lubricant, galling was remarkable. In a further example of drawing a metal with an oil lubricant after dipping in lime (AISI 304), galling was so remarkable that the drawing was impossible without oxalate coating or the like as a pretreatment.

The present inventors have made extensive studies for the purpose of obtaining a lubricant having an excellent galling resistance and other properties necessary for non-chip metal forming and, as a result, have found surprizingly that among alkali earth metal sulfates only calcium sulfate and barium sulfate are solid lubricants excellent in galling resistance and that a lubricant for non-chip metal forming excellent in galling resistance and other properties can be obtained by mixing calcium sulfate or barium sulfate with a conventional inorganic or organic solid or liquid lubricant and the pretreatment of the metal in non-chip metal forming can be simplified by using such a novel lubricant.

An object of this invention is to provide a lubricant for non-chip metal forming excellent in galling resistance.

Another object of this invention is to provide a lubricant for non-chip metal forming excellent in not only galling resistance but also other properties necessary for the lubricant.

A further object of this invention is to provide a method for non-chip metal forming by which the pretreatment of metal is simplified and the galling of metal is not caused.

Other objects and advantages of this invention will become apparent from the following description.

According to this invention, there is provided a lubricant for non-chip metal forming comprising (1) 5% by weight or more of at least one powdered sulfate selected from the group consisting of calcium sulfate and barium sulfate having a mean particle size of 100μ or less and (2) at least one conventional lubricant selected from the group consisting of inorganic solid lubricants, organic solid lubricants and organic liquid lubricants.

According to this invention, there is further provided a method for the non-chip metal forming, which comprises the steps of (1) subjecting a metal slug to a pretreatment of pickling, shot blasting, shot peening or sand blasting, (2) applying to the surface of the pretreated slug a lubricant for non-chip metal forming comprising (a) 5% by weight or more of at least one powdered sulfate selected from the group consisting of calcium sulfate and barium sulfate having a mean particle size of 100μ or less and (b) at least one conventional lubricant selected from the group consisting of inorganic solid lubricants, organic solid lubricants and organic liquid lubricants, and (3) subjecting the lubricant-coated slug to non-chip metal forming.

The favorable effect of calcium sulfate and barium sulfate on galling resistance can be demonstrated by hot rolling and warm forging of stainless steel of AISI 304. The hot rolling was performed at a rolling temperature of 1,200° C., using the solid lubricant prepared by mixing an alkali metal sulfate or an alkali earth metal sulfate with stearic acid, while pressing the lubricant against the rolls. In Table 1 are shown the results of tests on the wear of rolls and the surface roughness of the product after rolling of 100 angle bars. As seen from Table 1, reduced wear of the rolls and improved surface quality were achieved with a lubricant containing calcium sulfate or barium sulfate, as compared with other lubricants containing alkali metal sulfates and alkali earth metal sulfates except for calcium and barium sulfates.

Table 1

| Composition of lubricant (% by weight) | Wear of roll (mm) | Surface roughness of product (μ) |
|---|---|---|
| Beryllium sulfate 20 + stearic acid 80 | 0.20 | 48 |
| Magnesium sulfate 20 + stearic acid 80 | 0.23 | 50 |
| Calcium sulfate 20 + stearic acid 80 | 0.09 | 30 |
| Strontium sulfate 20 + stearic acid 80 | 0.19 | 46 |
| Barium sulfate 20 + stearic acid 80 | 0.12 | 35 |
| Lithium sulfate 20 + stearic acid 80 | 0.22 | 51 |
| Sodium sulfate 20 + stearic acid 80 | 0.24 | 55 |
| Potassium sulfate 20 + stearic acid 80 | 0.23 | 52 |
| Rubidium sulfate 20 + stearic acid 80 | 0.21 | 51 |
| Cesium sulfate 20 + stearic acid 80 | 0.25 | 53 |
| Mineral oil 1.5 + vegetable oil 0.5 + water 98 | 0.23 | 52 |

The warm forging of stainless steel of AISI 304 was performed by the cup extrusion method at a forging temperature of 500° C., in which a powdered lubricant comprising a mixture of an alkali metal sulfate or an alkali earth metal sulfate and graphite was coated on the slug and an aqueous dispersion of colloidal graphite was sprayed onto the die. The test results obtained were as shown in Table 2.

Table 2

| Composition of lubricant (% by weight) | Number of workpieces formed without galling |
|---|---|
| Beryllium sulfate 80 + graphite power 20 | 2 |
| Magnesium sulate 80 + graphite power 20 | 3 |
| Calcium sulfate 80 + graphite power 20 | 100 or more |
| Strontium sulfate 80 + graphite power 20 | 5 |
| Barium sulfate 80 + graphite power 20 | 100 or more |
| Lithium sulfate 80 + graphite power 20 | 2 |
| Sodium sulfate 80 + graphite power 20 | 2 |
| Potassium sulfate 80 + graphite power 20 | 2 |
| Rubidium sulfate 80 + graphite power 20 | 2 |
| Cesium sulfate 80 + graphite power 20 | 2 |

As seen from Table 2, 100 workpieces were formed without galling with a lubricant containing calcium sulfate or barium sulfate, whereas in the case of other lubricants containing an alkali metal sulfate or an alkali earth metal sulfate other than calcium and barium sulfates, only several workpieces were formed until galling took place. Thus, calcium sulfate and barium sulfate exhibit a far better galling resistance than alkali metal sulfates and other alkali earth metal sulfates. The reason for this seems to be that on account of a proper adherent metal scraping action exerted by calcium sulfate or barium sulfate, the adherent metal is scraped off before it piles up on a roll or die.

Calcium sulfate or barium sulfate, which is an essential ingredient of the lubricant of this invention, is not subject to deterioration of its lubricating performance at high temperatures, and does not undergo oxidation loss nor decomposition even in the hot-forming at about 1,200° C. Being highly resistant to galling, a calcium or barium sulfate based lubricant can protect at high temperatures and high pressures all over the vargine surface formed during deformation of the metal with a lubricant film, thus making it possible to perform warm or hot forgoing of such a steel as stainless steel which has been supposed as being easily susceptible to galling because of difficult formation of oxide film.

The calcium sulfate in this invention includes not only anhydrous gypsum ($CaSO_4$) but also all of its hydrate forms such as hemihydrate gypsum ($CaSO_4.\frac{1}{2}H_2O$) and dihydrate gypsum ($CaSO_4.2H_2O$). In preparing an aqueous dispersion of calcium sulfate, it is preferred to use dihydrate gypsum. When hemihydrate gypsum or anhydrous gypsum is used in preparing an aqueous dispersion, a coagulation retarder can be incorporated thereinto.

Figure 2:
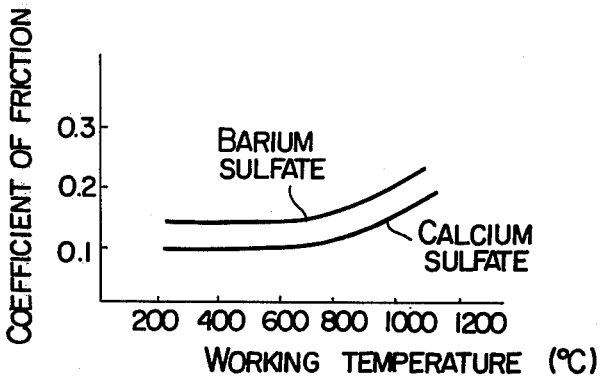
Figure 3:
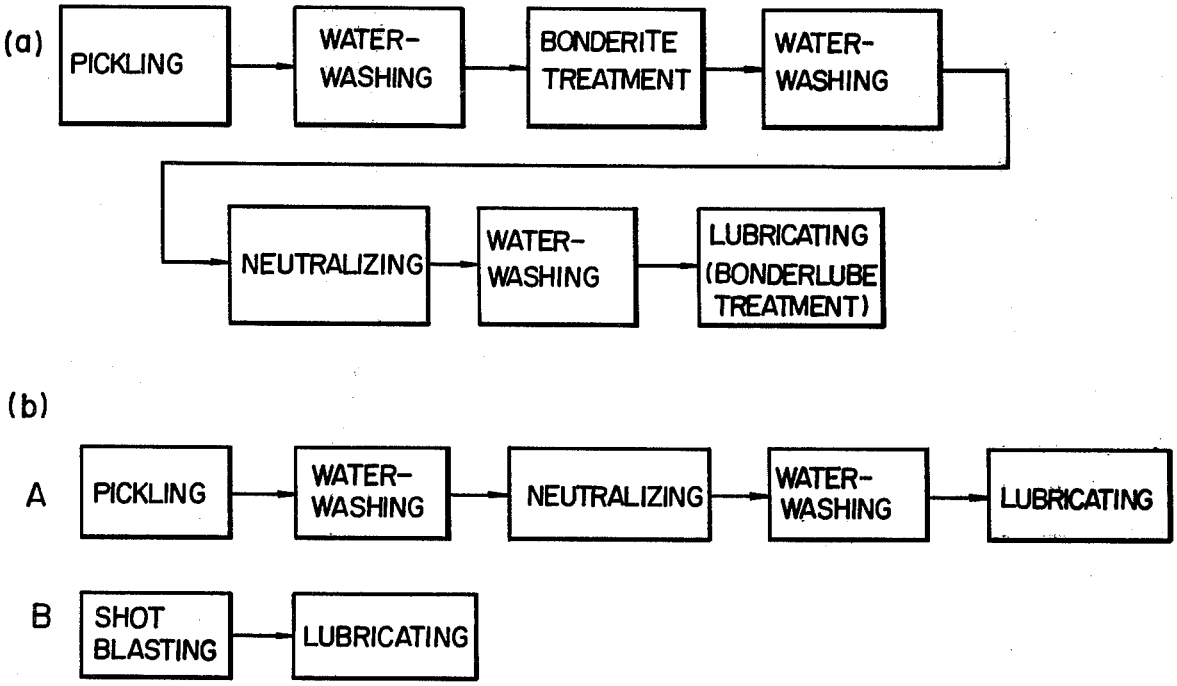
Figure 4:
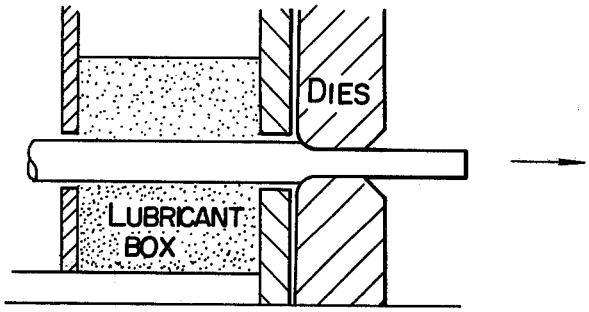
Figure 5:
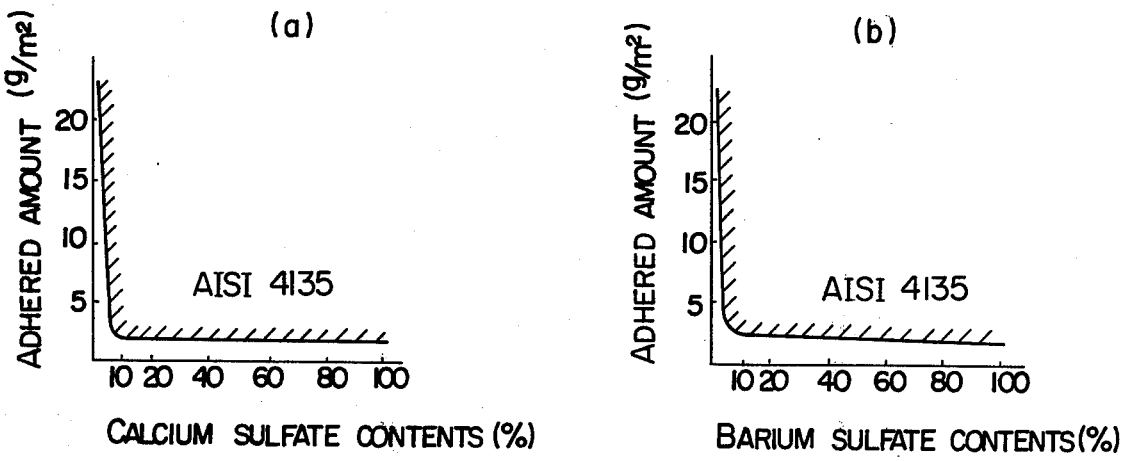
Figure 6:
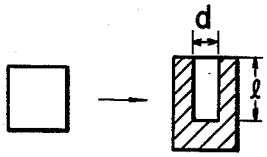

This invention is illustrated below in detail with reference to the accompanying drawings, in which FIG. 1 is a diagram representing the relationship between the mean particle size and the adhesiveness index of calcium sulfate;

FIG. 2 is diagrams representing the relationship between the working temperature and the friction coefficient of calcium sulfate and barium sulfate;

FIG. 3 (*a*) and (*b*) are flow-sheets indicating the difference in steps of pretreatment between the conventional cold forging process and the cold forging process according to this invention;

FIG. 4 is a rough sketch illustrating the drawing operation using the lubricant of this invention;

FIG. 5 (*a*) and (*b*) are diagrams representing respectively the relationship between the calcium sulfate content or barium sulfate content in the lubricant and the amount of the lubricant adhered to the slug, indicating the area wherein desirable lubrication is achieved without occurrence of galling and;

FIG. 6 represents an example of the shape of a workpiece and an extruded article.

The upper limit of the mean particle size of a powdered sulfate, which is a main ingredient of the lubricant of this invention, is set at 100μ, because, as shown in FIG. 1, if the mean particle size exceeds 100μ, the lubricant becomes inferior in adherence. A preferable means particle size is 50μ or smaller. The adhesiveness index in FIG. 1 is an index expressed in percentage based on the amount of calcium sulfate of a mean particle size of 50μ adhered to the slug.

The amount of calcium sulfate or barium sulfate incorporated into the lubricant of this invention is 5% by weight or more based on the total weight of the lubricant of this invention. For obtaining the satisfactory galling resistance, it is preferably to incorporate 10% by weight or more of calcium sulfate or barium sulfate. A part of calcium or barium sulfate can be replaced by the same amount of barium or calcium sulfate, respectively.

As shown in Table 2, calcium sulfate has a smaller coefficient of friction than barium sulfate, and calcium sulfate having water of crystallization loses, its water of crystallization as the temperature rises, to increase the viscosity, and hence, it acts as a viscosity-increasing agent. Therefore, the calcium sulfate has a more excellent lubricity.

In this invention, an improved adherence in metal forgoing is achieved by mixing one or both of the calcium and barium sulfates having a mean particle size of 100μ or less with 5 to 95% by weight of at least one inorganic solid lubricant selected from the group consisting of graphite, graphite fluoride, boron nitride, molybdenum disulfide, tungsten disulfide and zinc sulfide. As for the adherence, in addition to the adhered amount, the uniformity and tightness of adhesion of the lubricant film are important factors. Even the adhered amount is sufficient, if the lubricant film is lacking in uniformity or the tightness of adhesion is insufficient, the powdery ingredients fall away and accumulate in the die, causing, in some case, the formation of defective articles. In Table 3 are shown the results of tests conducted on the uniformity of lubricant film.

Table 3

| Lubricant | Percentage by weight of solid lubricant incorporated to improve adherence | | | | | | | | | | | | |
|---|---|---|---|---|---|---|---|---|---|---|---|---|---|
| | 0 | 2 | 5 | 10 | 20 | 30 | 40 | 50 | 60 | 70 | 80 | 90 | 95 |
| Ca sulfate + graphite | x | x | o | o | o | o | o | o | 0 | o | o | o | o |
| Ca sulfate + graphite fluoride | x | x | o | o | o | o | o | o | o | o | o | o | o |
| Ca sulfate + Mo disulfide | x | o | o | o | o | o | o | o | o | o | o | o | o |
| Ba sulfate + Zn sulfide | x | o | o | o | o | o | o | o | o | o | o | o | o |
| Ba sulfate + Mo disulfide | x | o | o | o | o | o | o | o | o | o | o | o | o |

Evaluation of uniformity of lubricant film:

Test pieces of 18-8 stainless steel, 20 mm $\phi \times 20$ mm, were washed with a 30% sulfuric acid at 80° C. for 30 minutes and coated with a powdered mixture comprising calcium sulfate of a mean particle size of 50μ or barium sulfate of a mean particle size of 1μ and a solid lubricant by tumbling the test pieces and the powdered mixture in a barrel revolving at 10 rpm for 30 minutes. On visual inspection of the coated test pieces, those showing no surface irregularities were rated as o and those showing surface irregularities were rated as x.

In Table 4 are shown the tightness of adhesion of the lubricant coating according to this invention, as estimated by the rattler test in which the formability of metal powder is examined.

Table 4

| Lubricant | Percentage by weight of solid lubricant incorporated to improve adherence | | | | | | | | | | | | |
|---|---|---|---|---|---|---|---|---|---|---|---|---|---|
| | 0 | 2 | 5 | 10 | 20 | 30 | 40 | 50 | 60 | 70 | 80 | 90 | 95 |
| Ca sulfate + graphite | x | x | o | o | o | o | o | o | o | o | o | o | o |
| Ca sulfate + Mo disulfide | x | Δ | o | o | o | o | o | o | o | o | o | o | o |
| Ba sulfate + graphite | x | Δ | o | o | o | o | o | o | o | o | o | o | o |

Evaluation of tightness of adhesion of lubricant film:

The test piece and the procedure of lubrication were the same as in the above-noted test for uniformity. The rattler test was performed by placing the test piece coated with a lubricant in a rattler tester, operating the tester at 90 rpm, and determining the amount of lubricant remaining adhered to the test piece after 100 revolutions. The test piece which showed a decrease of 10% or less in adhered amount was rated as o, that which showed a decrease of more than 10% but not more than 20% as Δ, and that which showed a decrease exceeding 20% as x.

Desirable uniformity and tightness of adhesion of the lubricant film are also obtained with a mixture of calcium sulfate and barium sulfate incorporated with 5 to 95% by weight of the above-noted solid lubricant.

An improvement in friction coefficient is also achieved by incorporating the above-noted inorganic solid lubricant into either of calcium sulfate or barium sulfate or a mixture thereof.

According to this invention, a lubricant in the aqueous dispersion form for use in forging and drawing is obtained by uniformly dispersing calcium sulfate, barium sulfate or a mixture thereof having a mean particle size of 50μ or less (B) in an aqueous colloidal graphite dispersion containing 0.3 to 30% by weight of graphite (A) so that dispersion contains 0.05 to 30% by weight of the sulfate (B), provided $B/(A+B)\times 100 \geqq 5\%$. When a slug is tightly coated with the lubricant by dipping the slug in the above aqueous dispersion, it becomes susceptible to forging and drawing at temperatures in a wide range from cold to hot.

The galling resistance is markedly affected by the sulfate content in said aqueous dispersion and the quantity of lubricant adhered to the slug on dipping the latter in said dispersion. An aqueous dispersion in which both the amount of graphite and the amount of the sulfate exceed 30% by weight is not desirable because of difficulty in formation of a uniform lubricant coating over the surface of a slug.

For evaluating the galling resistance, the slug was extruded into a cup in the ratio of inner depth to inner diameter (l/d) (see FIG. 6) of 2 by the backward extrusion method in a percentage reduction in cross-sectional area of 50% at a temperature of 500° C. The area in which a good lubricity is obtained is the area in which the amount of calcium or barium sulfate added is 5% or more based on the total weight of the graphite (A) contained in the colloidal graphite dispersion and the calcium sulfate and/or barium sulfate (B) ($B/[A+B]\times 100 \geqq 5$) as shown in FIGS. 5(*a*) and 5(*b*).

The organic solid lubricants which may be used in this invention include, for example, saturated fatty acids, waxes, metallic salts of saturated fatty acids and the like. The organic liquid lubricants which may be used in this invention include, for example, mineral oils, animal oils, vegetable oils, synthetic oils, and the like.

According to this invention, a further improvement in galling resistance in metal forging and drawing, in adherence and in friction coefficient is achieved by incorporating 3 to 95% by weight of a metallic salt of a saturated fatty acid in powdered calcium sulfate or powdered barium sulfate or a mixture thereof having a mean particle size of 100μ or less. Examples of suitable metallic salts of saturated fatty acids include salts of metals such as sodium, potassium, lithium, calcium, barium, magnesium, strontium, zinc, aluminum, and lead with saturated higher fatty acids having 11 or more carbon atoms such as lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid, lacceroic acid, and the like. These salts may be used alone or in admixture of two or more. If the amount of a metallic salt of a fatty acid added is below 3% by weight, the friction coefficient of the lubricant is not sufficiently low, giving rise to such problems that a loud noise unbearable for the workers is given off upon removal of the forged article from the die or the forged article is spontaneously released out of the die with a sudden jump.

In another embodiment of this invention, a lubricant for non-chip metal forming is obtained in the form of solid at room temperature by mixing 5 to 80%, preferably 10 to 80%, by weight of calcium and/or barium sulfate with 20 to 95% by weight of a fatty acid, wax or a mixture thereof and heating and melting the resulting mixture to form a uniform dispersion. The solid lubricant thus obtained is useful in the rolling of metals such as steel, aluminum, copper, and the like. In using the solid lubricant in metal rolling, it is applied by simply pressing it against the roll by means of an elastic tool such as a spring to ensure the adhesion. Because of incorporation of calcium sulfate and/or barium sulfate which is stable at a high temperature under a high pressure, the solid lubricant withstands a high contact surface pressure and prevents galling by keeping the rolls and the bar from direct contact.

The fatty acid used as soild matrix is selected from the group consisting of saturated fatty acids having 11 or more carbon atoms and a melting point of 40° C. or higher, including lauric acid, tridecylic acid, myristic acid, pentadecylic acid, palmitic acid, heptadecylic acid, stearic acid, nonadecanoic acid, arachic acid, behenic acid, lignoceric acid, cerotic acid, heptacosanoic acid, montanic acid, melissic acid and lacceroic acid. The wax is selected from those having a melting point of 40° C. or higher, including vegetable waxes such as, for example, carnauba wax, candelilla wax, cotton wax, palm wax, sugar cane wax, flax wax and tree wax; animal waxes such as, for example, bees wax, spermaceti wax, wool wax and insect wax; petroleum waxes and synthetic waxes such as, for example, paraffin wax, microcrystalline wax, petrolatum, polyolefin wax, chloronaphthalene wax, montan wax and ozokerite (ceresin).

In the above solid lubricant, if the sulfate content is below 5% by weight, the galling resistance is insufficient, whereas if it exceeds 80% by weight, a sufficiently solid lubricant is difficult to obtain. If the amount of a fatty acid, wax or a mixture thereof is below 20% by weight, a sufficiently solid lubricant is difficult to obtain, whereas if it exceeds 95% by weight, the galling resistance becomes unsatisfactory.

The solid lubricant can be further incorporated with 3 to 70% by weight of a metallic salt of a saturated fatty acid. In this case, the amount of saturated fatty acid, wax or both in the resulting solid lubricant is 17 to 92% by weight. The addition of the above metallic salt serves to improve further the strength of the lubricant film. The metallic salt of a saturated fatty acid is an extreme pressure additive and if the incorporated amount is below 3% by weight, the improvement in the strength of the lubricant film is insufficient, whereas if the amount exceeds 70% by weight, a sufficiently solid lubricant is difficult to obtain because of insufficient bonding of the metallic salt of a fatty acid. Suitable metallic salts of fatty acids include salts of metals such as sodium, potassium, lithium, calcium, magnesium, strontium, barium, zinc, aluminum and lead with the above-listed saturated fatty acids having 11 or more carbon atoms. These metallic salts may be used alone or in admixture of two or more.

A normally greasy lubricant for non-chip metal forming is obtained by mixing 5 to 80% by weight of calcium or barium sulfate or a mixture thereof, 3 to 30% by weight of a metallic salt of a fatty acid and 17 to 90% by weight of a mineral oil, an animal oil, a vegetable oil, or a synthetic oil, and heating and melting the mixture to form a uniform dispersion. If the amount of the sulfate is below 5% by weight, the galling resistance is insufficient, whereas if the amount exceeds 80% by weight, the formation of a grease becomes difficult. If the amount of a metallic salt of a saturated fatty acid is below 3% by weight, the lubricant has insufficient viscosity, whereas if the amount exceeds 30% by weight, the formation of a grease and the uniform dispersion become difficult.

Suitable mineral oils include dynamo oil, machine oil (#120, #160), motor oil (#30, #40), mobile oil, gear oil (No. 1–No. 8), cylinder oil (#90, #120), etc. Suitable animal oils are fish oil, whale oil, and neat's-foot oil and suitable vegetable oils are drying oils such as linseed oil, perilla oil, tung oil, etc.; semi-drying oils, such as sesame oil, rapeseed oil, cotton seed oil, soybean oil, etc.; non-drying oils, such as tsubaki oil, olive oil, castor oil, etc., and suitable synthetic oils are olefin polymer oils, diester oils, polyalkylene glycol oils, silicone oils, hydrocarbon halide oils, etc.

The above normally greasy lubricant for non-chip metal forming is useful in metal straightening.

In still another embodiment of this invention, there is provided a soild lubricant for non-chip metal forming comprising 5 to 80%, preferably 10 to 80%, by weight of calcium or barium sulfate or a mixture thereof, 16 to 91% by weight of a saturated fatty acid, wax or a mixture thereof, 3 to 70% by weight of a saturated metallic salt of fatty acid, and 1 to 20% by weight of a mineral oil, an animal oil, a vegetable oil, or a synthetic oil. This solid lubricant is useful in metal rolling.

In a further embodiment of this invention, there is obtained a liquid lubricant for non-chip metal forming comprising 5 to 30% by weight of calcium or barium sulfate or a mixture thereof and 70 to 95% by weight of at least one oil selected from the group consisting of mineral oils, animal oils, vegetable oils, and synthetic oils. This liquid lubricant is useful in drawing, forging or rolling of metals. When this liquid lubricant is used in hot forging or drawing of stainless steel, a complicated coating treatment becomes unnecessary and no problem is aroused with respect to working environment.

When the lubricant of this invention is used in non-chip metal forming of a steel, in contrast to a conventional lubricant, it is not necessary to add a large quantity of extreme pressure additives such as chlorine, phosphorus and sulfur, nor is it necessary for the slug or bar of steel to undergo a complicated pretreatment such as oxalate coating or Bonderite-Bonderlube treatment, and pickling, shot blasting, sand blasting or shot peening is sufficient as the pretreatment. The lubricant of this invention is applied to the slug or bar which has undergone such a simple pretreatment, and the slug or bar is subsequently subjected to non-chip metal forming such as cold forging, warm forging, hot forging, drawing, rolling or straightening in a conventional manner.

The above-noted Bonderite-Bonderlube treatment involves complicated steps as shown in FIG. 3. In the Bonderite treatment step, a zinc phosphate coating is formed on the slug surface and in the subsequent Bonderlube treatment step, the zinc phosphate coating reacts with sodium stearate to form a metallic soap composed of zinc stearate. Since the galling resistance of zinc stearate is insufficient, in spite of its low coefficient of friction, remarkable galling takes place in cold forging accompanied by large deformation if the slug of steel is protected with only the zinc stearate coating. In order to avoid such galling, the Bonderite treatment becomes necessary as pretreatment and the whole process becomes complicated as shown in FIG. 3.

Molybdenum disulfide has been used also as a lubricant for cold forging. Since the galling resistance of molybdenum disulfide is insufficient, the slug of steel is subjected to Bonderite treatment and then to molybdenum disulfide coating. Moreover, molybdenum disulfide is an expensive lubricant.

The lubricant of this invention has been developed in order to overcome the above difficulties. Owing to the incorporation of calcium sulfate or barium sulfate in the lubricant composition, the present inventors have succeeded in cold forging or drawing of metals such as steel, aluminum and copper which has undergone a simple pretreatment such as pickling or shot blasting.

The invention is further explained below in detail with reference to Examples which are merely by way of illustration and not by way of limitation. In the Examples, percentages are by weight unless otherwise specified.

EXAMPLE 1

For evaluating the galling resistance of the lubricant of this invention which is most strongly required for the warm forging of steel, the backward extrusion method was used, in which a slug was formed into a cup-shaped article as shown in FIG. 6 ($l/d=1.5$). The percentage reduction in cross-sectional area in the extrusion was 50%. The results of the tests were as shown in Table 5. The slug used was made of 18–8 stainless steel which is most liable to galling.

Table 5

| Lubricant | Incorporated amount of calcium sulfate or barium sulfate (%) | | | | | | | | | | | | |
|---|---|---|---|---|---|---|---|---|---|---|---|---|---|
| | 1 | 5 | 7 | 10 | 20 | 30 | 40 | 50 | 60 | 70 | 80 | 90 | 100 |
| Calcium sulfate | x | Δ | o | o | o | o | o | o | o | o | o | o | o |
| Barium sulfate | x | Δ | Δ | o | o | o | o | o | o | o | o | o | o |

The lubricant applied to the slug was a mixed powder of calcium sulfate having a mean particle size of 50μ or barium sulfate having a mean particle size of 1μ and pulverized graphite. The slug was pretreated with a pickling solution of 30% sulfuric acid at 80° C. for 30 minutes. The lubricant and the slugs were placed in a tumbling barrel, whereby the lubricant adhered to the slug surface. The extruding die was sprayed and lubricated with a 10% aqueous colloidal graphite solution. The working temperature was 500° C. and 100 slugs were formed in each run. Evaluation of galling resistance (unti-weld property): the cases where no galling was observed were estimated as o; the cases where no galling but several scorings were observed during the run were estimated as Δ and the cases where galling was observed during the run were estimated as x.

As seen from Table 5, galling and scoring were prevented by the incorporation of 5 to 100% of either calcium sulfate or barium sulfate. Similar results were obtained with a mixture of calcium sulfate and barium sulfate or when a known solid lubricant other than graphite was employed together with calcium or barium sulfate.

EXAMPLE 2

For evaluating the galling resistance of the lubricant of this invention which is most strongly required for the cold forging, the backward extrusion method was used, in which the slug was formed into a cup-shaped article. The percentage reduction in cross-sectional area in the extrusion was 70%. The results of tests were as shown in Table 6. The slug to be formed was prepared by lathing a steel bar of AISI 1015 or AISI 4118 which had been annealed into a size of 35 mm $\phi \times 35$ mm.

Table 6

| Type of steel | | Composition of lubricant (%) | Lubricity: Critical ratio of inner depth to inner diameter | Lubricity: Jump-out of formed article |
|---|---|---|---|---|
| | | Ba sulfate 10 + Ca stearate 90 | 2.0 | No |
| | | Ca sulfate 20 + Zn stearate 60 | 2.0 | " |
| | This invention | Ba sulfate 20 | | |
| | | Ba sulfate 97 + Zn stearate 3 | 2.0 | " |
| AISI 1015 | | Ba sulfate 15 + Ca palmitate 85 | 2.0 | " |
| | | Ba sulfate 80 + Ca palmitate 20 | 2.0 | " |
| | Conventional Reference | Bonderite - Bonderlube treatment | 2.0 | " |
| | | Ba sulfate 4 + Ca stearate 96 | 1.5 | " |
| | | Ba sulfate 99 + Zn stearate 1 | 2.0 | Yes |
| | | Ca sulfate 5 + Ca stearate 95 | 2.0 | No |
| | This invention | Ca sulfate 10 + Ca stearate 90 | 2.5 | " |
| | | Ca sulfate 20 + Zn stearate 80 | 2.5 | " |
| | | Ca sulfate 95 + Zn stearate 5 | 2.5 | No |
| | | Ca sulfate 10 + Ca palmitate 85 | 2.0 | " |
| AISI 4118 | | Ba sulfate 5 | | |
| | | Ca sulfate 80 + Ca palmitate 20 | 2.0 | " |
| | Conventional Reference | Bonderite - Bonderlube treatment | 2.0 | " |
| | | Ca sulfate + Ca stearate 97 | 1.5 | " |
| | | Ca sulfate 98 + Zn stearate 2 | 2.0 | Yes |

The lubricant applied to the slug was a mixed powder of calcium sulfate having a mean particle size of 10$\mu$ or barium sulfate having a mean particle size of 1$\mu$ and a metallic salt of a fatty acid. The slug was pretreated with a pickling solution of 15% sulfuric acid at 80° C. for 30 minutes. The lubricant and the slugs were placed in a tumbling barrel operated at 10 rpm, whereby the lubricant adhered to the surfaces of the slugs at a rate of 5–10 g/m$^2$ in 30 minutes. The working temperature was room temperature, and 100 slugs were formed in each run.

The galling resistance was evaluated by determining the critical ratio of inner depth to inner diameter (l/d) which means the maximum l/d ratio at which no galling was observed on 100 pieces of the formed articles.

As seen from Table 6, galling resistance comparable or superior to that in the case of the Bonderite-Bonderlube treatment was achieved when the lubricant contained 5% or more of calcium sulfate or barium sulfate (up to 95% of a metallic salt of a fatty acid) and 3% or more of a metallic salt of a fatty acid. When a lubricant of such a composition was used, the removal of the formed article from the die was smoothly carried out and there was neither loud noise on removal of the formed article nor jumpout of the formed article from the die.

EXAMPLE 3

By means of a drawing equipment of the draw bench type, steel bars, 13 mm in diameter, of AISI 1030 and AISI 304 were drawn into bars of 11.5 mm $\phi$ at a drawing speed of 10–20 m/minute. The lubricant applied to the bar was a mixed powder of calcium sulfate having a mean particle size of 10$\mu$ and a metallic salt of a fatty acid. A round bar, 6 m in length, which had been shot-blasted was passed through a lubricant box, filled with the above lubricant and positioned at the entrance to the drawing die as shown in FIG. 4, whereby the lubricant adhered to the surface of the round bar at a rate of 3–10 g/m$^2$. The bar was then immediately drawn. The test results were as shown in Table 7. Evaluation of the galling resistance was done by counting the number of drawn articles produced before the occurrence of galling.

Table 7

| Type of steel | | Composition of lubricant (%) | Drawing speed (m/min.) | Galling resistance (number of drawn bars) |
|---|---|---|---|---|
| | | Ca sulfate 5 + Ca stearate 95 | 15 | 100 or more |
| | This invention | Ca sulfate 10 + Ca stearate 90 | 15 | 100 or more |
| AISI 1030 | | Ca sulfate 50 + Zn stearate 50 | 15 | 100 or more |
| | | Ba sulfate 95 + Ca stearate 5 | 15 | 100 or more |
| | | Ca sulfate 90 + Zn stearate 10 | 20 | 100 or more |
| | Conventional Reference | $Ca(OH)_2$ → Drawing oil | 15 | 60 |
| | | Ca sulfate 2 + Ca stearate 98 | 15 | 70 |
| | | Ca sulfate 10 + Ca stearate 90 | 10 | 100 or more |
| | This invention | Ca sulfate 50 + Zn stearate 50 | 10 | 100 or more |
| | | Ba sulfate 95 + Ca stearate 5 | 10 | 100 or more |
| 304 | | Ba sulfate 90 + Zn stearate 10 | 15 | 100 or more |
| | Conventional Reference | $Ca(OH)_2$ → drawing oil | 10 | 30 |
| | | Ba sulfate 3 + Zn stearate 97 | 10 | 40 |

As seen from Table 7, by using a lubricant containing 5% or more of calcium sulfate or barium sulfate and 3% or more of a metallic salt of a fatty acid, 100 drawings were performed without occurrence of galling at a drawing speed of 15–20 m/min. in the case of AISI 1030 and 10–15 m/min. in the case of AISI 304. To the contrary, when a conventional lubricant was used, galling was observed at 60th drawing of AISI 1030 (drawing speed of 15 m/min.) and at 30th drawing of AISI 304 (drawing speed of 10 m/min.). When a reference lubricant was used, galling was observed at 70th drawing of AISI 1030 (drawing speed of 15 m/min.) and at 40th drawing of AISI 304 (drawing speed of 10 m/min.).

As described above, the present lubricant containing calcium sulfate or barium sulfate and a metallic salt of a fatty acid can form a lubricant film with low friction coefficient and excellent galling resistance on the surface of a slug which has undergone a simple pretreatment (shot blasting) and exhibits a lubricity comparable or superior to that of the lubricant film formed with conventional lubrication treatment in cold drawing. Moreover, the lubricant of this invention enables the lubrication procedure to be simplified and consequently can serve for reducing the cost, improving the productivity and preventing the water pollution being due to heavy metal ions.

EXAMPLE 4

Forging test was performed using test pieces, 35 mm $\phi \times 35$ mm, made of steel materials AISI 1045, AISI 4135 and AISI 304. The lubricant applied to the test piece was an aqueous dispersion prepared by uniformly dispersing calcium sulfate or barium sulfate, used as lubricant, in an aqueous colloidal graphite dispersion. The test piece, preheated at 300° C., was dipped in the above dispersion to form a uniform and tightly adhered lubricant film on the test piece. The heating was performed by means of an induction heater. The test piece was formed into a cup-shaped article by backward extrusion, in which the ratio of inner depth to inner diameter (1/d) was 2 and the percentage reduction in cross-sectional area was 50%. One hundred test pieces were formed in each run.

Table 8

| Type of steel | | Composition of lubricant in dispersion (%) | Adhered amount ($g/m^2$) | Working temp. (°C.) | Galling resistance |
|---|---|---|---|---|---|
| AISI 1045 | This invention | Ca sulfate 0.5 + graphite 1.0 | 5 | 500 | No galling |
| | | Ba sulfate 1.5 + graphite 2.0 | 7 | 700 | " |
| | Conventional | Graphite 2.0 | 6 | 500 | Galling at 11th extrusion |
| AISI 4135 | This invention | Ba sulfate 1.0 + graphite 1.0 | 6 | 500 | No galling |
| | | Ca sulfate 7.0 + graphite 2.0 | 8 | 700 | " |
| | Conventional | Graphite 2.0 | 6 | 500 | Galling at 8th extrusion |
| AISI 304 | This invention | Ca sulfate 14.0 + graphite 4.0 | 15 | 500 | No galling |
| | Reference | Ca sulfate 0.01 + graphite 2.0 | 6 | 500 | Galling at 2nd extrusion |

As shown in Table 8, 100 test pieces could be formed without galling according to this invention, whereas galling took place in a relatively early stage of forming and satisfactory forming was impossible when a conventional or reference lubricant was used.

EXAMPLE 5

Two hundred kilograms of AISI 304 billets, 110 mm square, were rolled into angle bars, 76.2 mm×6.35 mm, at a rolling temperature of 1,200° C. The lubricant employed was a normally solid lubricant, prepared by melting a fatty acid or wax at 80° to 100° C., mixing, with agitation, the molten fatty acid or wax with calcium sulfate or barium sulfate and a metallic salt of a fatty acid to form a uniform dispersion. The mixing ratio was varied. The lubricant was applied to the roll by pressing it against the roll at a pressure of 0.1–0.2 $kg/cm^2$ by means of a spring. The number of angle bars formed was 100 in each run. The test results were as shown in Table 9.

Table 9

| | Composition of lubricant (%) | Wear of roll (mm) | Surface roughness of product (μ) |
|---|---|---|---|
| This invention | Ca sulfate 5 + stearic acid 95 | 0.10 | 32 |
| | Ca sulfate 40 + paraffin 60 | 0.09 | 32 |
| | Ca sulfate 75 + stearic acid 25 | 0.07 | 30 |
| | Ba sulfate 30 + stearic acid 70 | 0.12 | 35 |
| | Ba sulfate 60 + paraffin 40 | 0.10 | 33 |
| | Ca sulfate 60 + stearic acid 35 + Ca stearate 5 | 0.02 | 18 |
| | Ca sulfate 20 + stearic acid 50 + Ca stearate 30 | 0.03 | 17 |
| | Ca sulfate 10 + stearic acid 30 + Zn stearate 60 | 0.03 | 18 |
| This invention | Ca sulfate 5 + paraffin 85 + Zn stearate 10 | 0.04 | 23 |
| | Ca sulfate 10 + stearic acid 80 + Ca stearate 10 | 0.03 | 19 |
| | Ba sulfate 20 + stearic acid 60 + Ca stearate 20 | 0.06 | 26 |
| | Ba sulfate 40 + stearic acid 40 + Ca stearate 20 | 0.04 | 25 |
| Conventional | Mineral oil 1.5 + veg. oil 0.5 + water 98 | 0.23 | 52 |
| | Mineral oil 4 + veg. oil 3 + fatty acid 1 + water 92 | 0.21 | 48 |
| Reference | Ca sulfate 1 + stearic acid 99 | 0.16 | 43 |
| | Ba sulfate 2 + paraffin 93 + Zn stearate 5 | 0.14 | 40 |

As seen from Table 9, in this invention, when a lubricant containing 5% or more of calcium sulfate or barium sulfate and 20% or more of a fatty acid or wax was used, the roll wear was 0.12 mm or less and the surface roughness of the product was 35μ or less. When 3 to 70% of a metallic salt of a fatty acid was incorporated into the above lubricant, the roll wear was 0.06 mm or less and the surface roughness of the product was 26μ or less. On the other hand, when a conventional lubricant was used, the roll wear was 0.21 mm or more and the surface roughness of the product was 48μ or more. When a reference lubricant was used, the roll wear was 0.14 mm or more and the surface roughness of the product was 40μ or more.

EXAMPLE 6

Ring-shaped articles, 231 mm outer dia.×198.5 mm inner dia.×30 mm height, for use in valves were produced in the following process: The slug was made of stainless steel of AISI 403. An intermediate product smaller in both outer diameter and inner diameter than the final product was prepared by forging the slug and then rolled on a rolling mill to obtain the final product. The forging temperature was 1150° C. The lubricant used was a liquid lubricant prepared by adding 5 to 30% of calcium sulfate having a mean particle size of 10μ or barium sulfate having a mean particle size of 1μ to a variety of lubricating oils. This liquid lubricant was applied by means of a brush to tools of the rolling mill, such as a profile roll and a mandrel roll. Evaluation of the lubricant was done by counting the number of articles formed until galling occurred. One hundred articles were formed in each run. The test results were as shown in Table 10.

Table 10

| | Composition of lubricant (%) | Number of articles produced until galling occurred | |
|---|---|---|---|
| | | Profile roll | Mandrel roll |
| This invention | Ca sulfate 5 + silicone oil 95 | 100 or more | 100 or more |
| | Ca sulfate 15 + cylinder oil 85 | 100 or more | 100 or more |
| | Ca sulfate 30 + rapeseed oil 70 | 100 or more | 100 or more |
| | Ba sulfate 10 + rapeseed oil 90 | 100 or more | 100 or more |
| | Ba sulfate 20 + cylinder oil 80 | 100 or more | 100 or more |
| Conventional | Rapeseed oil 100 | 5 | 2 |
| | Aqueous 10% colloidal graphite | 7 | 5 |
| Reference | Ca sulfate 1 + rapeseed oil 99 | 43 | 32 |
| | Ba sulfate 2 + cylinder oil 98 | 35 | 27 |

As seen from Table 10, 100 articles were produced without galling when the applied lubricant contained 5 to 30% of calcium sulfate or barium sulfate and any of the mineral oils, animal oils, vegetable oils and synthetic oils. On the other hand, the number of articles produced without galling was less than 7 with a conventional lubricant and less than 43 with a reference lubricant.

EXAMPLE 7

By means of a drawing equipment of the draw bench type, a steel far of AISI 304 of 13 mm ϕ was drawn into a bar of 11.5 mm ϕ at a drawing speed of 12 m/minute. A liquid lubricant prepared by mixing calcium sulfate having a mean particle size of 10μ or barium sulfate having a mean particle size of 1μ with a variety of oils was poured onto the bar just before entering the drawing die. The bar had been lime-treated before use. Evaluation of the lubricant was done by counting the number of bars drawn until galling occurred on the die or on the product. One hundred bars were drawn in each run. The results of drawing test were as shown in Table 11.

Table 11

| | Composition of lubricant (%) | Number of bars drawn until galling occured |
|---|---|---|
| This invention | Ca sulfate 5 + rapeseed oil 95 | 100 or more |
| | Ba sulfate 15 + rapeseed oil 85 | 100 or more |
| | Ca sulfate 30 + cylinder oil 70 | 100 or more |
| | Ca sulfate 10 + silicone oil 90 | 100 or more |
| | Ba sulfate 20 + machine oil 80 | 100 or more |
| Conventional | Rapeseed oil 100 | 10 |
| Reference | Ca sulfate 1 + rapeseed oil 99 | 30 |
| | Ba sulfate 2 + silicone oil 98 | 50 |

As seen from Table 11, 100 bars could be drawn without galling, when the applied lubricant contained 5 to 30% of calcium sulfate or barium sulfate and any of the mineral oils, animal oils, vegetable oils and synthetic oils. On the other hand, the number of bars drawn without galling was 10 with a conventional lubricant and 50 or less with a reference lubricant. Thus, the lubricant of this invention containing as an essential ingredient calcium sulfate or barium sulfate together with any of the mineral oils, animal oils, vegetable oils and synthetic oils serves for increasing the life of die, improving the product quality and productivity, and reducing the cost.

EXAMPLE 8

This lubricant was tested by using it in the straightening of a rolled channel bar (100 mm width×50 mm height×5,000 mm length) of AISI 304 which had been solution-treated. The lubricant in the grease form was prepared by adding with stirring a metallic salt of a fatty acid and calcium sulfate having a mean particle size of 50μ or barium sulfate having a mean particle size of 1μ to a mineral oil, animal oil, vegetable oil or synthetic oil which had been heated at 80° to 100° C. to give a greasy lubricant in which the ingredients were uniformly dispersed. The lubricant thus prepared was applied by means of a spreading roll to the surface of straightening rolls. The straightening was performed at a speed of 30 m/minute. The galling resistance was evaluated by counting the number of channel bars straightened until galling occurred. Fifty channel bars were straightened in each run.

Table 12

| | Composition of lubricant (%) | Galling resistance (number of straightened channel bars) |
|---|---|---|
| This invention | Ca sulfate 5 + Ca stearate 15 + #90 cylinder oil 80 | 50 or more |
| | Ca sulfate 40 + Ca stearate 5 + #90 cylinder oil 55 | " |
| | Ca sulfate 30 + Zn stearate 23 + #cylinder oil 47 | " |
| | Ba sulfate 30 + Ca stearate 30 + #cylinder oil 40 | " |

Table 12-continued

| | Composition of lubricant (%) | Galling resistance (number of straightened channel bars) |
|---|---|---|
| | Ba sulfate 40 + Zn stearate 10 + #90 cylinder oil 50 | " |
| Conventional | Water (no lubricant) | 10 |
| | Rapeseed oil 100 | 30 |
| Reference | Ca sulfate 1 + Ba stearate 39 + #120 machine oil 60 | 40 |

As seen from Table 12, 50 channel bars could be straightened without galling, when the lubricant contained 5 to 80% of calcium sulfate or barium sulfate, 17 to 90% of a mineral oil, animal oil, vegetable oil, or synthetic oil and 3 to 30% of a metallic salt of a fatty acid. On the other hand, the number of channel bars straightened without galling was 30 or less with a conventional lubricant and 40 with a reference lubricant.

EXAMPLE 9

Two hundred kilograms of AISI 304 billets, 110 mm square, were rolled into angle bars, 76.2 mm×6.35 mm, at a rolling temperature of 1,200° C. The lubricant employed was a normally solid lubricant prepared by adding with stirring calcium sulfate of a mean particle size of 50μ or barium sulfate of a mean particle size of 1μ, a metallic salt of a fatty acid and a fatty acid or a wax to a mineral oil, animal oil, vegetable oil or synthetic oil heated at 80° to 100° C., to disperse the ingredients uniformly. The solid lubricant thus obtained was applied to the roll by pressing the lubricant against the roll at a pressure of 0.03–0.10 kg/cm$^2$ by means of a spring. One hundred billets were rolled in each run. The test results obtained were as shown in Table 13.

Table 13

| | Composition of lubricant (%) | Roll wear (mm) | Surface roughness of product (μ) |
|---|---|---|---|
| | Ca Sulfate 5 + stearic acid 60 + Ca stearate 25 + cylinder oil 10 | 0.04 | 22 |
| This invention | Ca sulfate 25 + stearic acid 50 + Zn stearate 20 + cylinder oil 5 | 0.02 | 15 |
| | Ca sulfate 45 + paraffin 25 + Ca stearate 25 + cylinder oil 5 | 0.02 | 14 |
| | Ca sulfate 12 + paraffin 45 + Zn stearate 35 + cylinder oil 8 | 0.03 | 20 |
| | Ba sulfate 38 + paraffin 32 + Zn stearate 25 + rapeseed oil 5 | 0.04 | 23 |
| Conventional | Mineral oil 1.5 + vegetable oil 0.5 + water 98 | 0.23 | 52 |
| | Mineral oil 4 + vegetable oil 3 + fatty acid 1 + water 92 | 0.21 | 48 |
| Reference | Ca sulfate 1 + stearic acid 99 | 0.16 | 43 |
| | Ba sulfate 2 + paraffin 93 + Zn stearate 5 | 0.14 | 40 |

As seen from Table 13, when the lubricant contained 5 to 80% of calcium sulfate or barium sulfate, 16 to 91% of a fatty acid or wax, 3 to 70% of a metallic salt of a fatty acid and 1 to 20% of a mineral oil, animal oil, vegetable oil or synthetic oil, the roll wear was 0.04 mm or less and the surface roughness of the product was 23μ or less. The roll wear and surface roughness of the product were 0.21 mm or more and 48μ, respectively with a conventional lubricant and 0.14 mm or more, and 40μ or more, respectively with a reference lubricant. Therefore, it is apparent that the lubricant of this invention has a favorable effect on the reduction of roll wear and on the improvement of surface roughness of the product.

EXAMPLE 10

For the purpose of evaluating the performance in cold forging, the lubricant of this invention was applied to cold forging of a needle bearing housing. The slugs were prepared by shear-cutting a steel bars, 28 mm in diameter, of AISI 5120, which had been annealed and peeled, to the length of 27.8 mm and pretreated by dipping in a pickling solution of 15% sulfuric acid at 80° C. for 30 minutes. The lubricant being used was prepared by mixing calcium sulfate having a mean particle size of 10μ with zinc stearate to obtain a mixed powder. The slugs and the lubricant were placed in a tumbling barrel operating at 10 rpm, whereby the lubricant was adhered to the slugs at a rate of 5–10 g/m$^2$ in 30 minutes. It was found that as compared with conventional Bonderite-Bonderlube treatment, the pretreatment was simplified as the lubricating process using the lubricant of this invention did not require phosphate coating, and consequently the productivity was increased by 20%, the quality of the product being comparable.

EXAMPLE 11

The cold forging of Example 10 was repeated, except that powdered graphite was used in place of the zinc stearate. It was found that as compared with conventional Bonderite-Bonderlube treatment, the productivity was increased by 20% and the quality of the product was comparable as well as in the case of Example 10.

EXAMPLE 12

The lubricant of this invention was applied to the drawing of stainless steel bars. A 13 mm ϕ round bar of AISI 304 stainless steel, which had been solution-treated, was shot-blasted. The powdered lubricant being used was prepared by mixing calcium sulfate having a mean particle size of 10μ with calcium stearate. The round bar, 6 m in length, was passed through a lubricant box, which had been filled with the above lubricant and positioned at the entrance of a drawing die, whereby the lubricant adhered to the round bar. The round bar was drawn to 11.5 mm ϕ at a drawing speed of 12 m/minute. It was found that as compared with conventional lubricating treatment (oxalate coating—metallic soap coating), the pretreatment was simplified as the lublicating process using the lubricant of this invention did not require oxalate coating, the productivity was increased by 30%, and the quality of the product was comparable.

EXAMPLE 13

The drawing in Example 12 was repeated, except that molybdenum disulfide was used in place of calcium stearate. As compared with conventional oxalate treatment, the productivity was increased by 30%, and the quality of the product was comparable as well as in the case of Example 12.

EXAMPLE 14

The lubricant of this invention was applied to warm forging of a socket with cup-shape. The slugs were prepared by shear-cutting hot rolled steel bars, 30 mm in diameter, of AISI 4135 to the length of 34.4 mm and shot-blasted as pretreatment. A lubricant was prepared by mixing calcium sulfate having a mean particle size of 50μ with graphite. The powdered lubricant and the slugs were placed in a tumbling barrel operating at 10 rpm, whereby the lubricant was adhered to the surface of slugs at a rate of 5–10 g/m$^2$ in 30 minutes. The lubricant coated slug was heated to 600° C. by means of an induction heater and fed to a vertical transfer press. Water was sprayed onto a punch and die to cool these tools. As compared with conventional dual lubrication system, in which the die is sprayed with an aqueous colloidal graphite dispersion and the slug is coated with colloidal graphite by dipping, the present system has advantages in that the working environment is improved as the lubricating system using the lubricant of this invention does not require colloidal graphite spraying, and the productivity is increased by 10%, the quality of the product being substantially the same.

EXAMPLE 15

The lubricant of this invention was applied to the drawing of stainless steel bars in the different lubricating process for Example 12. A 13 mm ϕ round bar of AISI 304 which had been solution-treated was used. The round bar was pretreated with a pickling solution of 30% sulfuric acid at 80° C. for 30 minutes. A liquid lubricant prepared by mixing calcium sulfate having a mean particle size of 50μ with cylinder oil to form a dispersion was poured onto the ground bar just before entering the drawing die. The bar was drawn to 11.5 mm ϕ at a speed of 12 m/minute. As compared with conventional lubricating treatment (oxalate coating—metallic soap coating), the present system has an advantage in that the productivity is increased by 30% owing to omitting oxalate coating, the quality of the product being substantially the same.

What is claimed is:

1. A lubricant for non-chip metal forming consisting of (1) 5% by weight or more of at least one powdered sulfate selected from the group consisting of calcium sulfate and barium sulfate having a mean particle size of 100μ or less and (2) at least one conventional lubricant selected from the group consisting of graphite, graphite fluoride, boron nitride, molybdenum disulfide, tungsten disulfide, and organic solid lubricants.

2. A lubricant for non-chip metal forming according to claim 1, wherein the organic solid lubricants are selected from the group consisting of fatty acids, waxes and metallic salts of fatty acids.

3. A lubricant for non-chip metal forming according to claim 2, wherein the fatty acids, are lauric acid, tridecylic acid, myristic acid, pentadecylic acid, palmitic acid, heptadecylic acid, stearic acid, nonadecanoic acid, arachidic acid, behenic acid, lignoceric acid, cerotic acid, heptacosanoic acid, montanic acid, melissic acid, or lacceroic acid.

4. A lubricant for non-chip metal forming according to claim 2, wherein the waxes are carnauba wax, candelilla wax, cotton wax, palm wax, sugar cane wax, flax wax, tree wax, bees wax, spermaceti wax, wool wax, insect wax, paraffin wax, microcrystalline wax, petrolatum, polyolefin wax, chloronaphthalene wax, montan wax, or ozokerite.

5. A lubricant for non-chip metal forming according to claim 2, wherein the metallic salts of fatty acids are the lithium, sodium, potassium, magnesium, calcium, strontium, barium, zinc, aluminum or lead salts of lauric acid, tridecylic acid, myristic acid, pentadecylic acid, palmitic acid, heptadecylic acid, stearic acid, nonadecanoic acid, arachidic acid, behenic acid, lignoceric acid, cerotic acid, heptacosanoic acid, montanic acid, melissic acid, or lacceroic acid.

6. A lubricant for non-chip metal forming according to claim 1, wherein the graphite is colloidal graphite.

7. A lubricant for non-chip metal forming according to claim 1, wherein the conventional lubricant (2) is at least one inorganic solid lubricant selected from the group consisting of graphite, graphite fluoride, boron nitride, molybdenum disulfide, and tungsten disulfide, and the amount of said lubricant is 5 to 95% by weight.

8. A lubricant for non-chip metal forming according to claim 1, wherein the conventional lubricant (2) is a metallic salt of a fatty acid, and its amount is 3 to 95% by weight.

9. A lubricant for non-chip metal forming according to claim 1, wherein the amount of the sulfate is 5 to 80% by weight and the conventional lubricant (2) is a fatty acid, a wax or a mixture thereof, and its amount is 20 to 95% by weight.

10. A lubricant for non-chip metal forming according to claim 1, wherein the amount of the sulfate (1) is 5 to 80% by weight and the conventional lubricant (2) consists of 17 to 92% by weight of a fatty acid or a wax or a mixture thereof and 3 to 70% by weight of a metallic salt of a fatty acid, all the percentages being based on the total weight of the sulfate (1) and the conventional lubricant (2).

11. A lubricant for non-chip metal forming according to any one of claims 1,2,3,4,5,6,7, 8,9, or 10, wherein the amount of the sulfate is at least 10% by weight.

12. A lubricant for non-chip metal forming according to claim 1, wherein the sulfate (1) is calcium sulfate and the conventional lubricant (2) is graphite.

13. A lubricant for non-chip metal forming according to claim 1, wherein the sulfate (1) is calcium sulfate and the conventional lubricant (2) is molybdenum disulfide.

14. A lubricant for non-chip metal forming according to claim 1, wherein the sulfate (1) is barium sulfate and the conventional lubricant (2) is graphite.

15. A lubricant for non-chip metal forming according to claim 1, wherein the sulfate (1) is barium sulfate and the conventional lubricant (2) is molybdenum disulfide.

16. A lubricant for non-chip metal forming according to claim 1, wherein the sulfate (1) is calcium sulfate and the conventional lubricant (2) is colloidal graphite.

17. A lubricant for non-chip metal forming according to claim 1, wherein the sulfate (1) is barium sulfate and the conventional lubricant (2) is colloidal graphite.

18. A lubricant for non-chip metal forming according to claim 1, wherein the sulfate (1) is calcium sulfate and the conventional lubricant (2) is calcium stearate.

19. A lubricant for non-chip metal forming according to claim 1, wherein the sulfate (1) is calcium sulfate and the conventional lubricant (2) is zinc stearate.

20. A lubricant for non-chip metal forming according to claim 1, wherein the sulfate (1) is barium sulfate and the conventional lubricant (2) is calcium stearate.

21. A lubricant for non-chip metal forming according to claim 1, wherein the sulfate (1) is barium sulfate and the conventional lubricant (2) is zinc stearate.

22. A lubricant for non-chip metal forming according to claim 1, wherein the sulfate (1) is calcium sulfate and the conventional lubricant (2) is stearic acid.

23. A lubricant for non-chip metal forming according to claim 1, wherein the sulfate (1) is calcium sulfate and the conventional lubricant (2) is paraffin.

24. A lubricant for non-chip metal forming according to claim 1, wherein the sulfate (1) is barium sulfate and the conventional lubricant (2) is stearic acid.

25. A lubricant for non-chip metal forming according to claim 1, wherein the sulfate (1) is barium sulfate and the conventional lubricant (2) is paraffin.

26. A lubricant for non-chip metal forming according to claim 1, wherein the sulfate (1) is calcium sulfate and the conventional lubricant (2) consists of stearic acid and calcium stearate.

27. A lubricant for non-chip metal forming according to claim 1, wherein the sulfate (1) is calcium sulfate and the conventional lubricant (2) consists of stearic acid and zinc stearate.

28. A lubricant for non-chip metal forming according to claim 1, wherein the sulfate (1) is calcium sulfate and the conventional lubricant (2) consists of paraffin and calcium stearate.

29. A lubricant for non-chip metal forming according to claim 1, wherein the sulfate (1) is calcium sulfate and the conventional lubricant (2) consists of paraffin and zinc stearate.

30. A method for non-chip metal forming which comprises subjecting a slug to a pretreatment which is pickling, shot blasting, shot peening or sand blasting, coating the pretreated slug with a lubricant for non-chip metal forming comprising (1) 5% by weight or more of at least one sulfate selected from the group consisting of calcium sulfate and barium sulfate having a mean particle size of 100μ or less and (2) at least one conventional lubricant selected from the group consisting of graphite, graphite fluoride, boron nitride, molybdenum disulfide, tungsten, disulfide, and organic solid lubricants, and then subjecting the coated slug to non-chip metal forming.

31. A method for non-chip metal forming according to claim 30, wherein the pretreatment is pickling.

32. A method for non-chip metal forming according to claim 30, wherein the pretreatment is shot blasting.

33. A method for non-chip metal forming according to claim 30, wherein the non-chip metal forming is cold forging.

34. A method for non-chip metal forming according to claim 30, wherein the non-chip metal forming is warm forging.

35. A method for non-chip metal forming according to claim 30, wherein the non-chip metal forming is drawing.

36. A method for non-chip metal forming according to claim 30, wherein the non-chip metal forming is cold rolling.

37. A method for non-chip metal forming according to claim 30, wherein the conventional lubricant (2) is graphite, molybdenum disulfide, tungsten disulfide, graphite fluoride, boron nitride, or a mixture thereof.

38. A method for non-chip metal forming according to claim 37, wherein the non-chip metal forming is cold forging.

39. A method for non-chip metal forming according to claim 37, wherein the non-chip metal forming is warm forging.

40. A method for non-chip metal forming according to claim 37, wherein the non-chip metal forming is drawing.

41. A method for non-chip metal forming according to claim 30, wherein the organic solid lubricant is a metallic salt of a fatty acid.

42. A method for non-chip metal forming according to claim 41, wherein the non-chip metal forming is cold forging.

43. A method for non-chip metal forming according to claim 41, wherein the non-chip metal forming is drawing.

* * * * *